United States Patent [19]

Cormier

[11] Patent Number: 4,567,477

[45] Date of Patent: Jan. 28, 1986

[54] SMOKE DETECTOR SWITCH INDICATOR

[76] Inventor: Laurent L. Cormier, 484 Trudeau St., Ville LaSalle, Quebec, Canada, H8R 3C4

[21] Appl. No.: 647,266

[22] Filed: Sep. 4, 1984

Related U.S. Application Data

[63] Continuation-in-part of Ser. No. 504,607, Jun. 15, 1983, abandoned.

[51] Int. Cl.[4] ..... G08B 21/00; G08B 17/10

[52] U.S. Cl. ..... 340/644; 200/61.83; 200/85 R; 200/161; 200/308; 340/628

[58] Field of Search ..... 340/628, 644, 691; 200/161, 308, 61.9, 61.93, 52 R, 85 R, 51.04, 61.83, 61.03; 116/214, 215; 40/19.5

[56] References Cited

U.S. PATENT DOCUMENTS

| | | | |
|---|---|---|---|
| 450,923 | 4/1891 | Woolley | 200/85 R X |
| 452,288 | 5/1891 | Savage | 200/85 R X |
| 900,613 | 10/1908 | Tickner et al. | 200/85 R X |
| 1,833,513 | 11/1931 | Bean, Jr. et al. | 40/19.5 |
| 2,735,908 | 2/1956 | Peretti et al. | 200/157 |
| 3,145,375 | 8/1964 | Webb | 200/61.58 R |
| 4,004,120 | 1/1977 | Lee | 200/310 |
| 4,027,165 | 5/1977 | Jacobs | 340/629 X |
| 4,056,816 | 11/1977 | Guim | 340/638 |
| 4,135,859 | 1/1979 | Carson et al. | 417/63 X |
| 4,155,081 | 5/1979 | Haglund | 340/629 |
| 4,216,468 | 8/1980 | Kaufmann | 340/628 X |
| 4,313,110 | 1/1982 | Subulak et al. | 340/628 X |

*Primary Examiner*—James L. Rowland
*Assistant Examiner*—Daniel Myer
*Attorney, Agent, or Firm*—McCormick, Paulding & Huber

[57] ABSTRACT

A smoke detector indicator for a fire alarm system having an ON-OFF switch indicator system that permits the audio alarm to be turned off for false alarm situations, but has a visual indication that the system is not in operation. In a system including a circuit connecting a smoke detector, battery and an audio alarm, all in a single enclosure, the improvement comprises a switch in the circuit to open the circuit and prevent the alarm from sounding, and a visual indicator associated with the switch, visually apparent when the circuit is open, and not visually apparent when the circuit is closed.

5 Claims, 5 Drawing Figures

SMOKE DETECTOR SWITCH INDICATOR

This application is a continuation-in-part of U.S. patent application Ser. No. 504,607 filed June 15, 1983 now abandoned.

BACKGROUND OF THE INVENTION

The present invention relates to smoke detectors, and more particularly to a device that turns off a smoke detector, but gives a visual indication that the detector has been turned off.

The majority of households are today fitted with smoke detectors of one type or another. Perhaps the most common smoke detector is a simple battery operated unit which is generally mounted on the ceiling in a passage, hallway, staircase or the like, in a location where there is at least a partial air flow sothat if a fire does occur, smoke will be monitored by the smoke detector, and a signal given. Most smoke detectors have a horn or buzzer which sounds when the smoke is detected. The detector system may include ionization type detectors to detect smoke or gas, as well as heat detectors which sound the alarm when a preset temperature is reached. The battery ensures that the detector operates even in the event of a power failure.

These types of smoke detectors are sold in hardware stores, department stores, and the like, and some households have two or three units at different locations in the house, apartment or living areas. Hotels, offices, and public buildings usually have multiple units with monitoring heads in different rooms; however, the present invention relates more to a single smoke detector, rather than a multiple unit.

One problem that exists with the single unit smoke detector and is apparent in households is the difficulty in resetting the smoke detector alarm after it has gone off due to a false signal. False signals occur from time to time primarily when cooking occurs, for instance, burnt toast can produce sufficient smoke to set off a smoke detector, deep frying cooking can also set off an alarm, as well as other types of cooking that occur regularly in a household. Once the alarm on the smoke detector commences, it can continue for up to a half hour before the mechanism of the detecting device resets itself. Thus, the household has to put up with this alarm for as long as a half hour, and this is generally considered intolerable. In most cases, householders disconnect the smoke detector, and this has to be done by climbing up and disconnecting the battery from the smoke detector in the ceiling. Whereas there is an incentive to climb up and disconnect the battery because of the noise from the detector itself, once the battery has been disconnected, it is often forgotten and not reconnected. Therefore, the smoke detector is inoperative and stays in that condition until someone remembers to reconnect the battery. Thus, the whole purpose of a smoke detector is destroyed because it has been disconnected for a false alarm and then not reconnected.

It is a principal object of the present invention to provide an indicator wherein a smoke detector is disconnected temporarily, and when it is in the off position a visual indicator clearly shows that it is disconnected. When the particular smoke condition that triggered the alarm is dispersed, the indicator can be clearly seen, and the smoke detector reconnected.

SUMMARY OF THE PRESENT INVENTION

The present invention resides in a fire alarm system including a circuit connecting a smoke detector with an audio alarm. The circuit also has a power source connected in the circuit for energizing the alarm when the smoke detector senses an unsafe smoke condition. A temporary disabling and warning device is provided for disabling the alarm system and indicating the disabled condition. The device includes an electrical switch in the circuit connecting the detector and alarm to selectively open the circuit and prevent the alarm from sounding in the presence of a smoke condition, such as that caused by the starting of a fire in a fireplace, or the cooking of food in a toaster or on an open grill.

The device further includes weighted disabling and indicating means for actuating the electrical switch to open the circuit. The means has a weight sensitive operating member and a cooperative, weighting actuating and indicating member. The weight sensitive member connects to the switch to actuate the switch between the normally closed and the open circuit condition when the weighted actuating and indicating member is releasably engaged and supported by the operating member, and a visual indicator on the indicating member is visible to indicate that the circuit of the smoke detector is open and therefore unable to signal an unsafe smoke condition.

Accordingly, the invention comprises a temporary disabling and warning device that prevents the smoke detector from signalling a smoke condition, and at the same time, provides a warning of the disablement.

DESCRIPTION OF THE PREFERRED EMBODIMENTS

Figure 1:
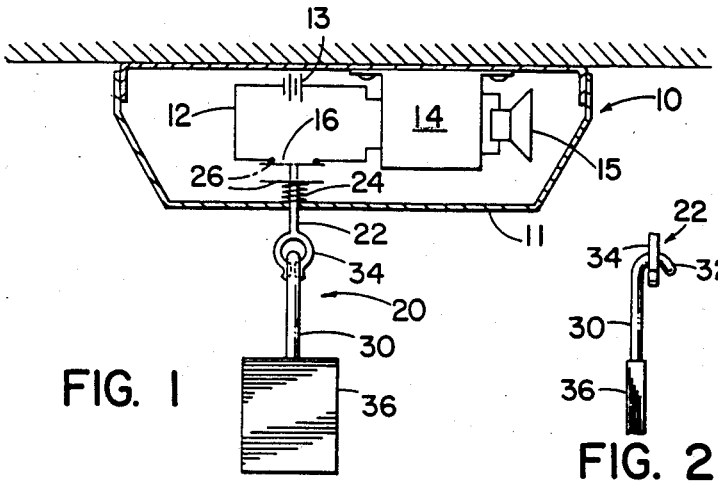
FIG. 1 is a schematic side view of a smoke detector with a weighted disabling and indicating device which deactivates the smoke detector.
Figure 2:
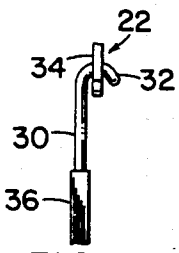
FIG. 2 is a fragmentary view of the weighted disabling and indicating device as viewed from the right in FIG. 1.
Figure 3:
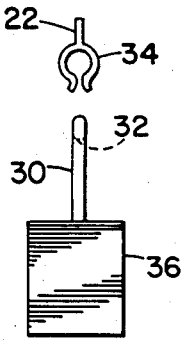
FIG. 3 is a fragmentary view of the weighted disabling and indicating device with the weighted indicator disconnected from the operating link.

FIGS. 1, 2, and 3 illustrate a ceiling mounted fire alarm system 10 including a smoke detector 14 within a housing 11. The system 10 has an electrical circuit 12 that includes a battery 13 for energizing the smoke detector 14 as well as an audible alarm 15. A normally closed electrical switch 16 is included in the circuit 12, and when the switch is closed, the circuit is similarly closed and energizes the smoke detector 14. Any smoke that is sensed by the detector causes the alarm 15 to sound. Such smoke may come from so-called friendly fires, such as those that are produced during cooking or in a fireplace, or from hostile fires that pose a danger to life and property. Unfortunately, the smoke detector is not capable of discriminating between friendly and hostile fire. For this reason, the smoke detector triggers the alarm 15 in the presence of friendly fires and produces an annoying sound until the smoke from the fire dissipates. If the switch 16 is opened, the fire alarm system is disabled, and the alarm cannot sound.

The present invention comprises a weighted disabling and indicating device, generally designated 20, to actuate the electrical switch 16 and disable the smoke detector temporarily. The disabling and indicating device is comprised fundamentally of an operating link 22, which is normally biased upwardly from the illustrated solid-line position to the phantom position by means of a coil spring 24 interposed between an electrical contact element 26 of the normally closed switch 16 and the housing 11, and a weighted indicator 30. In the upper position of the link 22, the contact element 26 engages the contacts of the circuit 12 and completes the electrical circuit between the battery 13 and the smoke detector 14. In the illustrated lower position, the weight sensitive operating link 22 and the contact 26 are pulled downwardly in opposition to the spring 24 by virtue of the weighted indicator 30, and the circuit 12 is opened.

Accordingly, the weight of the indicator 30 is sufficient to oppose the upward force of the spring 24 on the contact 26, and the contact is drawn downwardly to the illustrated solid-line position of FIG. 1 with the circuit 12 open and the smoke detector 14 disabled. Under these circumstances, the alarm 15 cannot sound even in the presence of an unsafe smoke condition, and to provide a warning of this condition, the bob weight 36 at the lower end of the indicator 30 is constructed with a large surface that is brightly painted. Alternatively, a ribbon or other visually apparent device may be connected to the weighted indicator.

The weighted indicator 30 may extend downwardly to eye level so that the indicator is readily observed by those occupying the space that is protected by the alarm system. When the indicator 30 is observed, individuals will know or can be advised that the alarm system is temporarily disabled due to the presence of "friendly fires". If such fires are not present, then the individuals will know that the indicator should be removed in order to reactivate the alarm system.

The operating link 22 and the weighted indicator 30 are coupled together by inserting a hook 32 at the upper end of the indicator through a resiliently releasable catch ring 34 at the lower end of the operating link. The catch ring defines a narrow slot at one circumferential location in the ring shape, and the slot is narrower than the parallel dimension of the hook 32 as shown in FIG. 3 in order to releasably engage and support the indicator 30 in the link 22 as shown in FIGS. 1 and 2.

Reactivation of the alarm system with the novel coupling formed by the hook 32 and catch ring 34 is easily performed by simply pulling the indicator out of the catch ring through the slot formed between the opposed, resilient portions of the ring. Once the weighted indicator 30 has been removed from the operating link 22, the coil spring 24 returns the contact member of switch 16 to the normally closed position illustrated in phantom in FIG. 1, and the circuit energizing smoke detector 14 is again closed. The fire alarm is now reenergized, and a brief glance at the empty catch ring 34 of the operating link 22 apprises people in the vicinity of the alarm system that it is operative once again.

Figure 4:
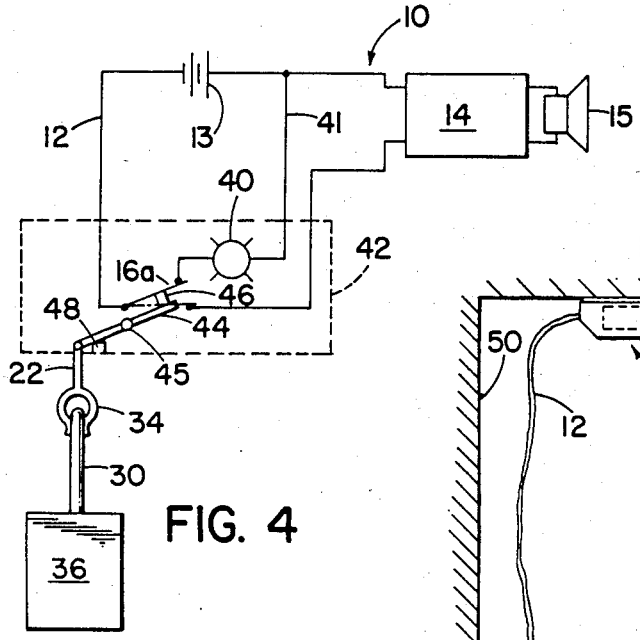
FIG. 4 is a schematic diagram showing an alternate embodiment of the invention with a light indicator.

FIG. 4 shows another embodiment of the invention which includes an indicator light 40 with a separate circuit 41. In contrast to the switch 16 in FIG. 1, the switch **16*a* is a double-throw toggle switch that not only opens the circuit to the smoke detector 14, but simultaneously closes the circuit 41 through an indicator light 40 when the weighted indicator 30 is suspended from the operating link 22. The operating link is connected to one end of an arm 44 pivotally mounted on a horizontal axis 45 within the housing 42 which can be remote from the detector 14. A stub 46 at one end of the pivot arm 44 engages the movable contact of the switch 16*a* when the weighted indicator is suspended from the operating link 22 and moves the movable switch contact away from the stationary contact connected to the smoke detector into engagement with the contact associated with the indicator light 40. In this position, the pivot arm rests against a stop 48 and the switch 16*a* disables the detector and energizes the light. Both the light and the weighted indicator provide a warning of the disabled condition of the fire alarm system 10**.

Preferably, the portion of the pivot arm 44 at one side of the pivot axis 45 is heavier than the opposite portion of the arm and the operating link 22 so that the stub 46 drops away from the movable element of the switch **16*a* when the weighted indicator 30 is removed from the catch ring 34. Under these circumstances, no stress is placed against the movable contact of the switch 16*a*, and it is not necessary to provide a large biasing force in the switch to restore the movable contact to the normally (phantom) closed position which energizes the smoke detector 14**.

Figure 5:
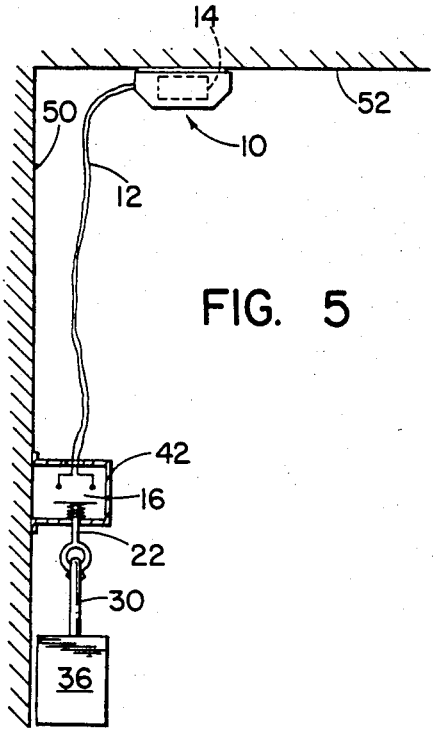
FIG. 5 shows an embodiment of the invention with the weighted disabling and indicating device located remotely from the smoke detector for easy access by handicapped and other persons.

FIG. 5 discloses another embodiment of the fire alarm system in which the electrical switch 16 in the smoke detector 12 is located in the housing 42 at waist height on a wall 50 remote from the smoke detector 14 on the ceiling 52. Such a remote mounting of the switch is advantageous for the elderly, handicapped, or incapacitated individuals who cannot reach upwardly toward the ceiling in order to attach the weighted indicator 30 to the ring of the operating link 22.

In summary, a fire alarm system has been disclosed in which the electrical circuit contains a switch operated by a weighted indicator to temporarily disable the detector when friendly smoke conditions are known or anticipated. The weighted indicator 30 visually informs individuals with the protected area of the disabled alarm system and permits the alarm system to be readily restored to an active condition when the smoke has dissipated.

While the present invention has been described in a preferred embodiment, it should be understood that numerous modifications and substitutions can be made without departing from the spirit of the invention. For example, although each of the smoke detector circuits described above includes a battery, it should be understood that the weighted indicator can also be employed in AC powered detectors to interrupt power to the smoke detector. The catch ring and engaging hook forming the coupling between the weighted indicator and the operating link may be replaced by other manually engageable and disengageable couplings without changing the overall operation of the apparatus. Accordingly, the present invention has been described in a preferred embodiment by way of illustration rather than limitation.

The embodiments of the invention in which an exclusive property or privilege is claimed, are defined as follows:

1. In a fire alarm system including a circuit connecting a smoke detector with an alarm and having a power source connected in the circuit for energizing the alarm when the smoke detector senses an unsafe smoke condition, a temporary disabling and warning device for disabling the alarm and indicating the disabled condition comprising:

an electrical switch in the circuit having an open circuit condition to prevent the alarm from sounding in the presence of a smoke condition, and a normally closed circuit condition in which the system is operative; and weighted disabling and indicating means operatively associated with the electrical switch and including a weight sensitive operating member connected with the electrical switch to actuate the switch between the normally closed and the open circuit condition, and a weighted actuating and indicating member releasably engageable with the weight sensitive operating member by means of a resilient coupling to actuate the electrical switch from the normally closed to the open circuit condition when the weight of the actuating and indicating member is supported by the operating member through the coupling, the resilient coupling having a resilient member maintaining the weighted actuating member and the operating member coupled together in a freely suspended condition of the actuating member, and resiliently releasing the actuating member from the operating member upon the application of a downwardly directed force to the actuating and indicating member in the suspended condition to thereby allow the electrical switch to assume the normally closed condition, the actuating and indicating member also having a visual indicator visible when the weight of the member is supported by the operating member and the circuit of the smoke detector is open.

2. The fire alarm system according to claim 1 wherein the resilient member of the resilient coupling for the weight sensitive operating member and the weighted actuating and indicating member comprises a resiliently releasable ring.

3. The fire alarm system according to claim 1 wherein the electrical switch is located in the circuit remotely of the smoke detector for easy access to the weight sensitive operating member with the weighted actuating and indicating member.

4. The fire alarm system according to claim 1 wherein the electrical switch in the smoke detector circuit has a movable contact, and the weight sensitive operating member of the weighted disabling and indicating means is pivotally mounted about a generally horizontal axis with a first portion of the member on one side of the axis engageable with a movable contact of the electrical switch, and a second portion on the other side of the axis engageable with the weighted actuating member, the first portion being heavier than the second portion to disengage from the movable contact of the switch when the weighted actuating member is not supported by the operating member.

5. In a fire alarm system including a circuit connecting a smoke detector with an alarm and having a power source connected in the circuit for energizing the alarm when the smoke detector senses an unsafe smoke condition, a temporary disabling and warning device for disabling the alarm and indicating the disabled condition comprising:

an electrical switch in the circuit having an open circuit condition to prevent the alarm from sounding in the presence of a smoke condition, and a normally closed circuit condition in which the system is operative; and weighted disabling and indicating means operatively associated with the electrical switch and including a weight sensitive operating member connected with the electrical switch to actuate the switch between the normally closed and the open circuit condition and a weighted actuating and indicating member releasably engageable with the weight sensitive operating member to actuate the electrical switch from the normally closed to the open circuit condition when the weight of the actuating and indicating member is supported by the operating member, the weight-sensitive operating member having a resilient catch ring defining a narrow slot at one circumferential location, and the weighted actuating and indicating member having a hook engageable with and supported by the ring, and resiliently releasable from the ring through the slot to allow the electrical switch to assume the normally closed condition, the actuating and indicating member also having a visual indicator visible when the weight of the member is supported by the operating member and the circuit of the smoke detector is open.

* * * * *